US009227395B2

(12) United States Patent
Hatanaka

(10) Patent No.: US 9,227,395 B2
(45) Date of Patent: Jan. 5, 2016

(54) IMAGE PROCESSING APPARATUS, IMAGE PROCESSING METHOD, AND IMAGE PROCESSING SYSTEM

(71) Applicant: Shinichi Hatanaka, Tokyo (JP)

(72) Inventor: Shinichi Hatanaka, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/633,362

(22) Filed: Feb. 27, 2015

(65) Prior Publication Data

US 2015/0251412 A1 Sep. 10, 2015

(30) Foreign Application Priority Data

Mar. 7, 2014 (JP) ..... 2014-045728

(51) Int. Cl.
*B41J 2/045* (2006.01)

(52) U.S. Cl.
CPC ..... *B41J 2/04535* (2013.01); *B41J 2/04595* (2013.01)

(58) Field of Classification Search
CPC ..... B41J 2/0456; B41J 2/0458; B41J 2/0459; B41J 2/2128; B41J 2/04591
USPC ..... 347/9–12, 14, 15, 19, 43, 57
See application file for complete search history.

(56) References Cited

U.S. PATENT DOCUMENTS 8,995,022 B1 * 3/2015 Vronsky et al. ..... 358/3.06
2013/0241987 A1 9/2013 Hatanaka

FOREIGN PATENT DOCUMENTS

JP 2000-318140 11/2000

* cited by examiner

*Primary Examiner* — Thinh Nguyen
(74) *Attorney, Agent, or Firm* — Harness, Dickey & Pierce, P.L.C.

(57) ABSTRACT

An image processing apparatus includes an acquiring unit, a first calculating unit, a setting unit, a second calculating unit, a first generating unit, and a second generating unit. The acquiring unit acquires image data of an image to be formed by a recording unit using an inkjet system. The first calculating unit calculates a thickness of ejected ink for each pixel based on the image data. The setting unit sets a target thickness of the image. The second calculating unit calculates a difference between the target thickness and the thickness of ink for each pixel. The first generating unit generates complementary data, in which an ejection amount of an additional droplet to realize a thickness corresponding to the difference is defined for each pixel. The second generating unit generates print data containing the image data and the complementary data.

13 Claims, 11 Drawing Sheets

IMAGE PROCESSING APPARATUS, IMAGE PROCESSING METHOD, AND IMAGE PROCESSING SYSTEM

CROSS-REFERENCE TO RELATED APPLICATIONS

The present application claims priority to and incorporates by reference the entire contents of Japanese Patent Application No. 2014-045728 filed in Japan on Mar. 7, 2014.

BACKGROUND OF THE INVENTION

1. Field of the Invention

The present invention relates to an image processing apparatus, an image processing method, and an image processing system.

2. Description of the Related Art

There is a known recording apparatus of an inkjet system that forms images by ejecting droplets, such as ink, from a nozzle. Further, a technology has been disclosed that realizes three-dimensional shapes by ejecting ink in a layered manner and adjusting the number of the layers by using the inkjet system.

However, an ejection amount of ink needed to realize a color of each pixel of an image to be formed varies depending on the color of each pixel. Therefore, the thickness of a formed image may vary depending on the color of each pixel. In this manner, conventionally, an unintended thickness difference sometimes occurs in a formed image.

The present invention has been conceived in view of the above, and there is a need for an image processing apparatus, an image processing program, an image processing method, and an image processing system capable of preventing occurrence of an unintended thickness difference in a formed image.

SUMMARY OF THE INVENTION

It is an object of the present invention to at least partially solve the problems in the conventional technology.

According to the present invention, there is provided an image processing apparatus comprising: an acquiring unit that acquires image data of an image to be formed by a recording unit using an inkjet system; a first calculating unit that calculates a thickness of ejected ink for each pixel based on the image data; a setting unit that sets a target thickness of the image; a second calculating unit that calculates a difference between the target thickness and the thickness of ink for each pixel; a first generating unit that generates complementary data, in which an ejection amount of an additional droplet to realize a thickness corresponding to the difference is defined for each pixel; and a second generating unit that generates print data containing the image data and the complementary data.

The present invention also provides an image processing method comprising: acquiring image data of an image to be formed by a recording unit using an inkjet system; calculating a thickness of ejected ink for each pixel based on the image data; setting a target thickness of the image; calculating a difference between the target thickness and the thickness of ink for each pixel; generating complementary data, in which an ejection amount of an additional droplet to realize a thickness corresponding to the difference is defined for each pixel; and generating print data containing the image data and the complementary data.

The present invention also provides an image processing system comprising: an image processing apparatus; and a recording apparatus, wherein the image processing apparatus includes: an acquiring unit that acquires image data of an image to be formed by a recording unit using an inkjet system; a first calculating unit that calculates a thickness of ejected ink for each pixel based on the image data; a setting unit that sets a target thickness of the image; a second calculating unit that calculates a difference between the target thickness and the thickness of ink for each pixel; a first generating unit that generates complementary data, in which an ejection amount of an additional droplet to realize a thickness corresponding to the difference is defined for each pixel; a second generating unit that generates print data containing the image data and the complementary data; and an output unit that outputs the print data to the recording apparatus, and the recording apparatus includes the recording unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an image processing apparatus, an image processing method, and an image processing system will be described in detail below with reference to the accompanying drawings.

Figure 1:
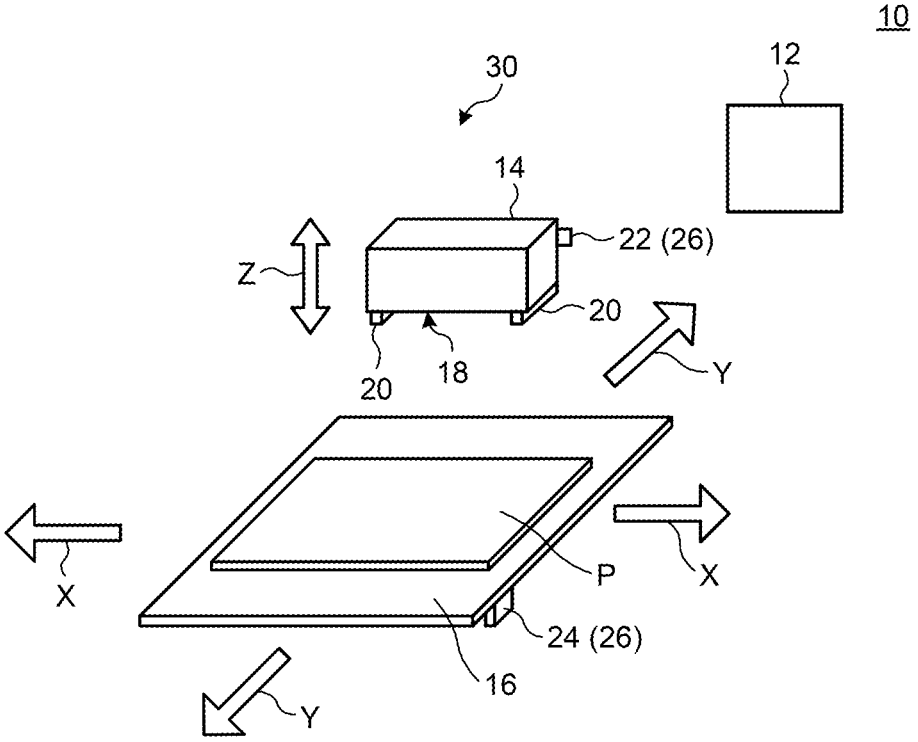
FIG. 1 is a diagram illustrating an example of an image processing system according to the present invention.

FIG. 1 is a diagram illustrating an example of an image processing system 10.

The image processing system 10 includes an image processing apparatus 12 and a recording apparatus 30. The image processing apparatus 12 and the recording apparatus 30 are communicably connected to each other.

The recording apparatus 30 includes a recording unit 14, an operating stage 16, and a driving unit 26. The recording unit 14 includes a plurality of nozzles 18. The recording unit 14 is a recording unit of an inkjet system, and records dots by ejecting droplets from each of the nozzles 18. The nozzles 18 are arranged on a surface facing the operating stage 16 in the recording unit 14.

In the embodiment, a droplet includes at least one of an ink droplet and an additional droplet. The ink droplet is a droplet of ink containing a color material used to form an image. That is, in the embodiment, an image means an image formed with ink.

The additional droplet is a droplet of a color that does not influence an image. For example, the additional droplet is white or transparent (clear) in color. The additional droplet may have the same type of color as a support P on which an image is to be formed. The support P is an object on which an image is to be formed with ink droplets. For example, the support P may be a recording medium. The support P may be configured by ejecting droplets by using an inkjet system or the like.

The ink droplet and the additional droplet are curable with stimulus. Examples of the stimulus include light (ultraviolet, infrared, or the like), heat, and electricity. In the embodiment, a case will be described in which the ink droplet and the additional droplet are curable with ultraviolet, for example. The ink droplet and the additional droplet are not limited to those curable with ultraviolet.

In the recording unit 14, irradiation units 20 are mounted on the surface facing the operating stage 16. The irradiation units 20 irradiates the support P with light with a wavelength at which the ink droplet and the additional droplet ejected from the nozzles 18 are cured. In the embodiment, the irradiation units 20 emit ultraviolet.

The operating stage 16 holds the support P. The driving unit 26 moves the recording unit 14 and the operating stage 16 relative to each other in a vertical direction (a direction of arrow Z in FIG. 1), a main-scanning direction X perpendicular to the vertical direction Z, or the sub-scanning direction Y perpendicular to the vertical direction Z and the main-scanning direction X.

In the embodiment, a plane formed by the main-scanning direction X and the sub-scanning direction Y corresponds to an XY plane along a surface facing the recording unit 14 in the operating stage 16.

The driving unit 26 includes a first driving unit 22 and a second driving unit 24. The first driving unit 22 moves the recording unit 14 in the vertical direction Z, the main-scanning direction X, and the sub-scanning direction Y. The second driving unit 24 moves the operating stage 16 in the vertical direction Z, the main-scanning direction X, and the sub-scanning direction Y. The recording apparatus 30 may be configured to include either one of the first driving unit 22 and the second driving unit 24.

Figure 2:
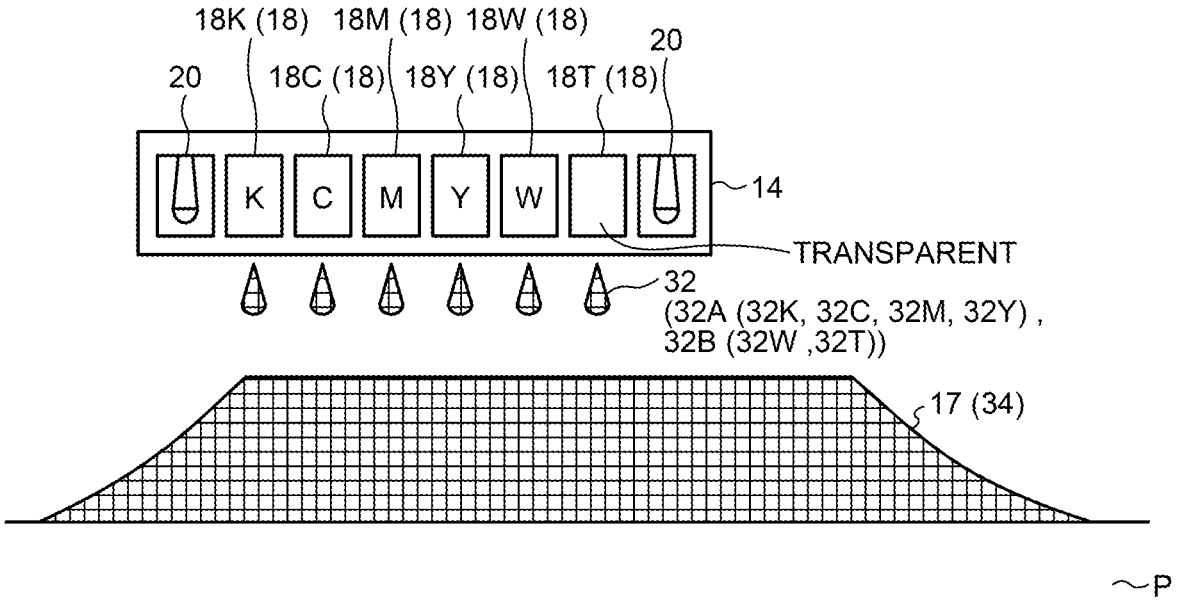
FIG. 2 is a diagram for explaining a recording unit of the image processing system.

FIG. 2 is a diagram for explaining the recording unit 14.

The recording unit 14 is configured such that the nozzles 18 are arranged in a predetermined direction. Each of the nozzles 18 ejects, as a droplet 32, an ink droplet 32A, an additional droplet 32B, or a mixture of the ink droplet 32A and the additional droplet 32B (not illustrated in FIG. 2). The nozzles 18 and the configuration to eject droplets are the same as those of well-known inkjet systems.

In the embodiment, nozzles 18K, 18C, 18M, 18Y, 18W, and 18T are arranged in the predetermined direction. The nozzles 18K, 18C, 18M, and 18Y are the nozzles 18 that eject the ink droplets 32A. Specifically, the nozzle 18K elects a black ink droplet 32K. The nozzle 18C ejects a cyan ink droplet 32C. The nozzle 18M ejects a magenta ink droplet 32M. The nozzle 18Y ejects a yellow ink droplet 32Y.

The nozzles 18W and 18T are the nozzles 18 that eject the additional droplets 32B. Specifically, the nozzle 18W ejects a white additional droplet 32W. The nozzle 18T ejects a transparent (clear) additional droplet 32T.

When each of the nozzles 18 ejects the droplets 32, dots 34 corresponding to the droplets 32 are formed on the support P, and an image 17 is formed with color materials contained in the ink droplets 32A. It is possible to form the image 17 three-dimensionally by forming a layer of the dots 34 by ejecting the droplets 32 in a layered manner.

FIG. 2 illustrates a case in which each of the nozzles 18 ejects the droplet 32 of a single color (a single type). However, each of the nozzles 18 may eject a droplet in which a plurality of types of the droplets 32 are mixed. The colors of ink ejected from the recording unit 14 are not limited to black, cyan, magenta, and yellow. The types of the droplets 32 ejected from the recording unit 14 are not limited to six types (black, cyan, magenta, yellow, white, and transparent (clear)).

In the embodiment, the irradiation units 20 are arranged at both ends in the arrangement direction of the nozzles 18K, 18C, 18M, 18Y, 18W, and 18T. When the droplet 32 ejected from each of the nozzles 18 is irradiated with light from the irradiation units 20, the droplet 32 is cured. It is preferable to arrange the irradiation units 20 near the nozzles 18. By arranging the irradiation units 20 near the nozzles 18, it becomes possible to reduce a curing time from when the droplet 32 ejected from each of the nozzles 18 adheres to the support P side to when the droplet 32 is cured. Consequently, it becomes possible to form a high-definition image. The number of the irradiation units 20 and the arrangement positions of the irradiation units 20 are not limited to those illustrated in FIG. 2.

Referring back to FIG. 1, in the recording apparatus 30, it is possible to form the dots 34 with the droplets 32 or form a layer of the dots 34 on the support P by moving the recording unit 14 and the support P relative to each other while ejecting the droplets 32 from the nozzles 18 of the recording unit 14. The support P may be in a planar shape or a three-dimensional shape with irregularities or the like.

Figure 3:
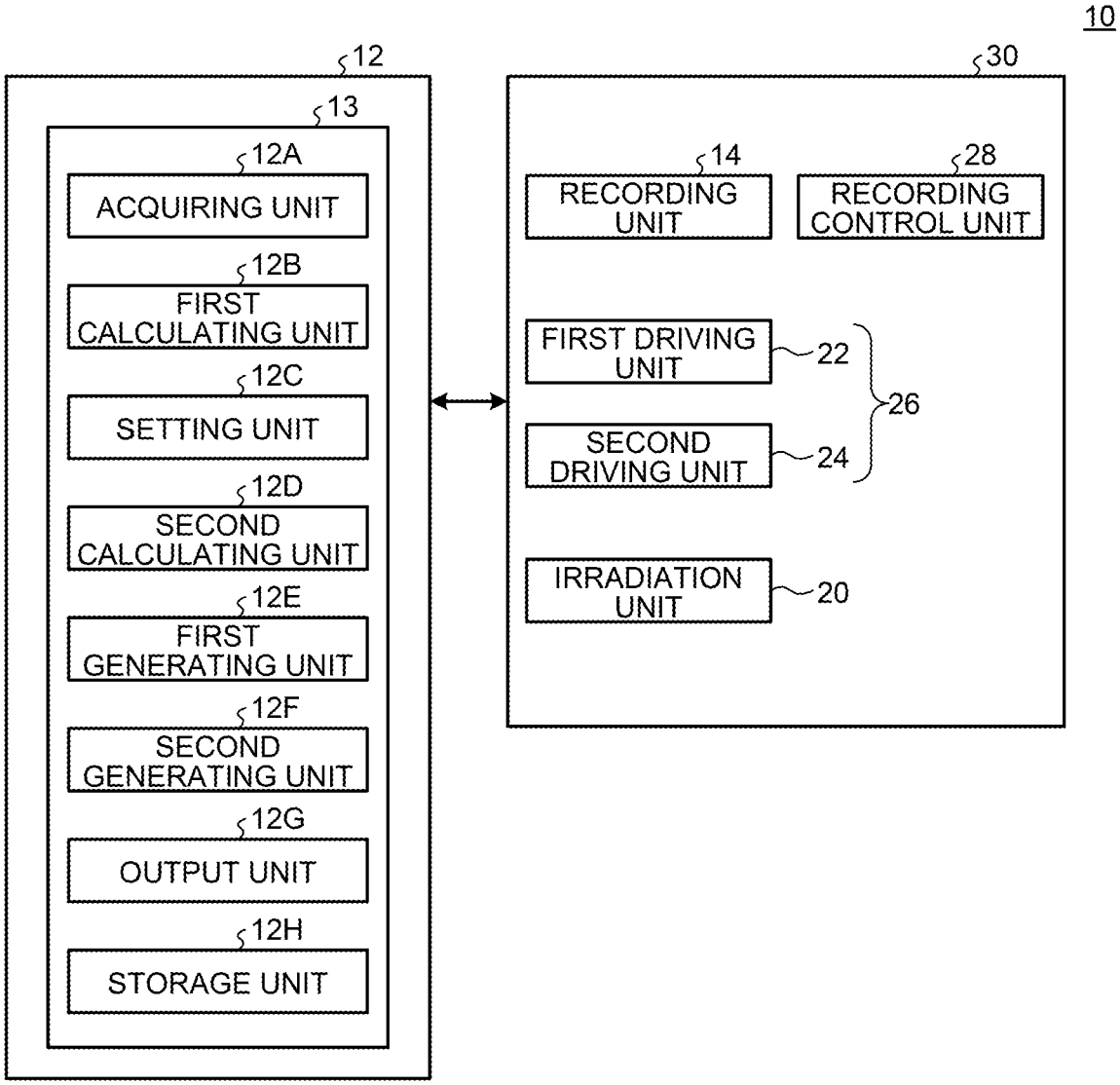
FIG. 3 is a functional block diagram of the image processing system.

FIG. 3 is a functional block diagram of the image processing system 10.

The recording apparatus 30 includes the recording unit 14, a recording control unit 28, the driving unit 26, and the irradiation units 20. The recording unit 14, the driving unit 26, and the irradiation units 20 are described above, and therefore, explanation thereof will not be repeated.

The recording control unit 28 receives print data from the image processing apparatus 12. The recording control unit 28 controls the recording unit 14, the driving unit 26, and the irradiation units 20 so that the nozzles 18 eject the droplets 32 corresponding to respective pixels in accordance with the received print data.

The image processing apparatus 12 includes a main control unit 13. The main control unit 13 is a computer configured to include a central processing unit (CPU) or the like, and controls the entire image processing apparatus 12. The main control unit 13 may be configured by other than a general-purpose CPU. For example, the main control unit 13 may be configured by a circuit or the like.

The main control unit 13 includes an acquiring unit 12A, a first calculating unit 12B, a setting unit 12C, a second calculating unit 12D, a first generating unit 12E, a second generating unit 12F, an output unit 12G, and a storage unit 12H.

All or part of the acquiring unit 12A, the first calculating unit 12B, the setting unit 12C, the second calculating unit 12D, the first generating unit 12E, the second generating unit 12F, and the output unit 12G may be implemented by causing a processor, such as a CPU, to execute a computer program, that is, by software, or may be implemented by hardware, such as an integrated circuit (IC), or a combination of software and hardware.

The acquiring unit 12A acquires image data. The image data is image data of an image formed by the recording unit 14 of the recording apparatus 30. Further, the image data is image data of an image formed with the ink droplets 32A as described above. The acquiring unit 12A may acquire the image data from an external apparatus via a communication unit (not illustrated), or may acquire the image data from a storage unit (not illustrated) provided in the image processing apparatus 12.

An ejection amount of the ink droplet 32A to realize a color of each of pixels of the image varies depending on the color of each of the pixels. Therefore, a thickness of a formed image may vary depending on the color of each of the pixels. That is, conventionally, an unintended thickness difference sometimes occurs in a formed image. The unintended thickness difference occurs due to irregularities that are not indicated by the image data. That is, the unintended thickness is a thickness different from a thickness of an area corresponding to each of pixels according to the image data.

The unintended thickness difference as described above may become a problem particularly when the dots 34 are formed in a layered manner on the support P to form a three-dimensional image with a desired thickness determined by the number of layers of the dots 34. That is, in the image data, information is defined so that a three-dimensional image with a desired thickness can be obtained by adjusting the number of layers of the dots 34 based on the assumption that the thickness of each layer is the same.

However, conventionally, the thickness of ink of a pixel area corresponding to each of pixels varies in each of layers, depending on the color of each of the pixels. Therefore, conventionally, there may be a case in which an unintended three-dimensional image is obtained or a desired thickness is not obtained.

Figure 4:
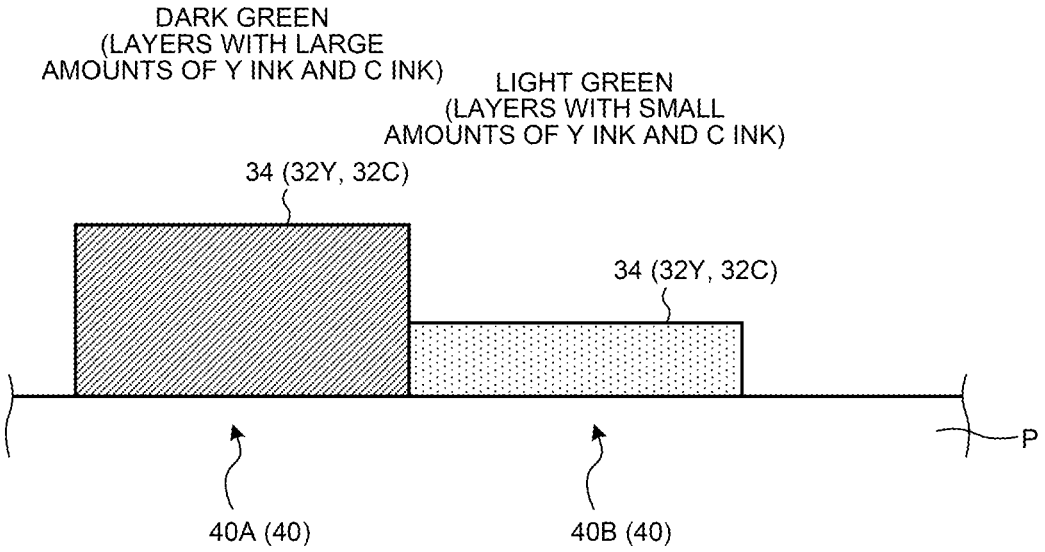
FIG. 4 is a diagram illustrating an example of a cross section of an image formed by a conventional system.

FIG. 4 is a diagram illustrating an example of a cross section of an image with dots of one layer formed by a conventional system. It is assumed that the color of a certain pixel of image data of an image to be formed is deep green. It is assumed that a deep green dot 34 is formed in a pixel area 40A corresponding to the certain pixel on the support P. It is assumed that the color of a pixel adjacent to the certain pixel is light green. It is assumed that a light green dot 34 is formed in a pixel area 40B corresponding to the adjacent pixel on the support P.

In this case, to realize the deep green dot 34 in the pixel area 40A on the support P, for example, predetermined amounts or more (large amounts) of a yellow ink droplet 32Y and a cyan ink droplet 32C are ejected and thereafter cured by the irradiation units 20. To realize the light green dot 34 on the pixel area 40B, for example, less than the predetermined amounts (small amounts) of the yellow ink droplet 32Y and the cyan ink droplet 32C are ejected and thereafter cured by the irradiation units 20.

Therefore, as illustrated in FIG. 4, even though the dots 34 of the same one layer are formed in both of the deep green pixel area 40A and the light green pixel area 40B on the support P, there is a difference between the thicknesses of ejected ink.

Therefore, conventionally, irregularities due to an unintended thickness difference may occur on an image or an intended thickness of ink may not be obtained.

Figure 5:
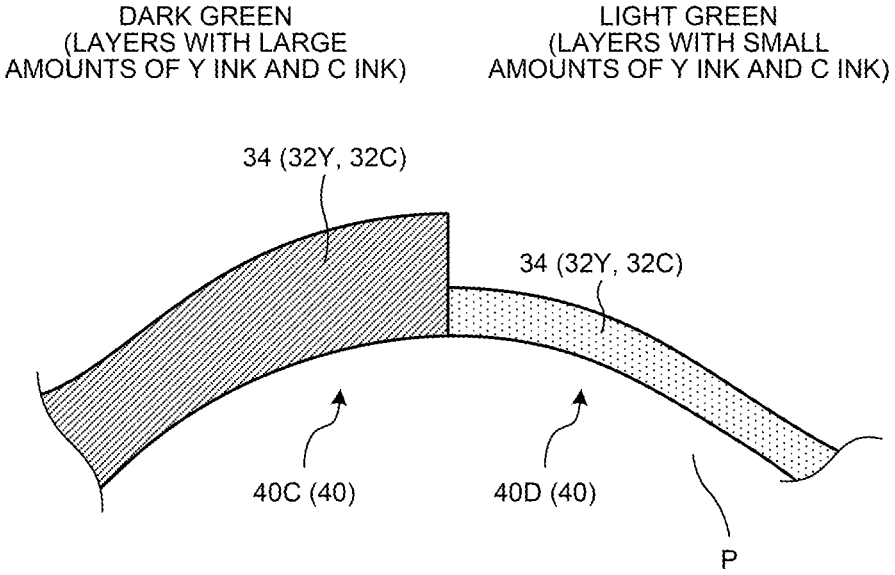
FIG. 5 is a diagram illustrating an example of a cross section of an image formed by the conventional system.

FIG. 5 is a diagram illustrating an example of a cross section of an image formed on the support P having an irregular area on the surface thereof by the conventional system.

Similarly to FIG. 4, it is assumed that the color of a certain pixel of image data of an image to be formed is deep green. It is assumed that the deep green dot 34 is formed in a pixel area 40C corresponding to the certain pixel on the support P. It is assumed that the color of a pixel adjacent to the certain pixel is light green. It is assumed that the light green dot 34 is formed in a pixel area 40D corresponding to the adjacent pixel.

In this case, to realize the deep green dot 34 in the pixel area 40C on the support P, for example, predetermined amounts or more (large amounts) of the yellow ink droplet 32Y and the cyan ink droplet 32C are ejected and thereafter cured by the irradiation units 20. To realize the light green dot 34 on the pixel area 40D, for example, less than the predetermined amounts (small amounts) of the yellow ink droplet 32Y and the cyan ink droplet 32C are ejected and thereafter cured by the irradiation units 20.

Even in this case, similarly to the above, there is a difference in the thicknesses of ink between the deep green pixel area 40C and the light green pixel area 40D on the support P having the irregular area.

It is assumed that the recording unit 14 can eject, as the ink droplet 32A, ink of four colors of cyan, magenta, yellow, and black. In this case, even at the same brightness (density), the amount of ink ejected to the blue pixel area 40 is greater when the cyan pixel area 40 formed with only the cyan ink droplet 32C and the blue pixel area 40 formed with the cyan ink droplet 32C and the magenta ink droplet 32M are compared with each other. Therefore, conventionally, an unintended thickness difference due to the color of each pixel may occur in a formed image.

Further, the thickness of ink in the pixel area 40 corresponding to each pixel varies depending on the color of each pixel; therefore, conventionally, the unintended thickness difference on an image increases with an increase in the number of layers of the dots 34.

Figure 6:
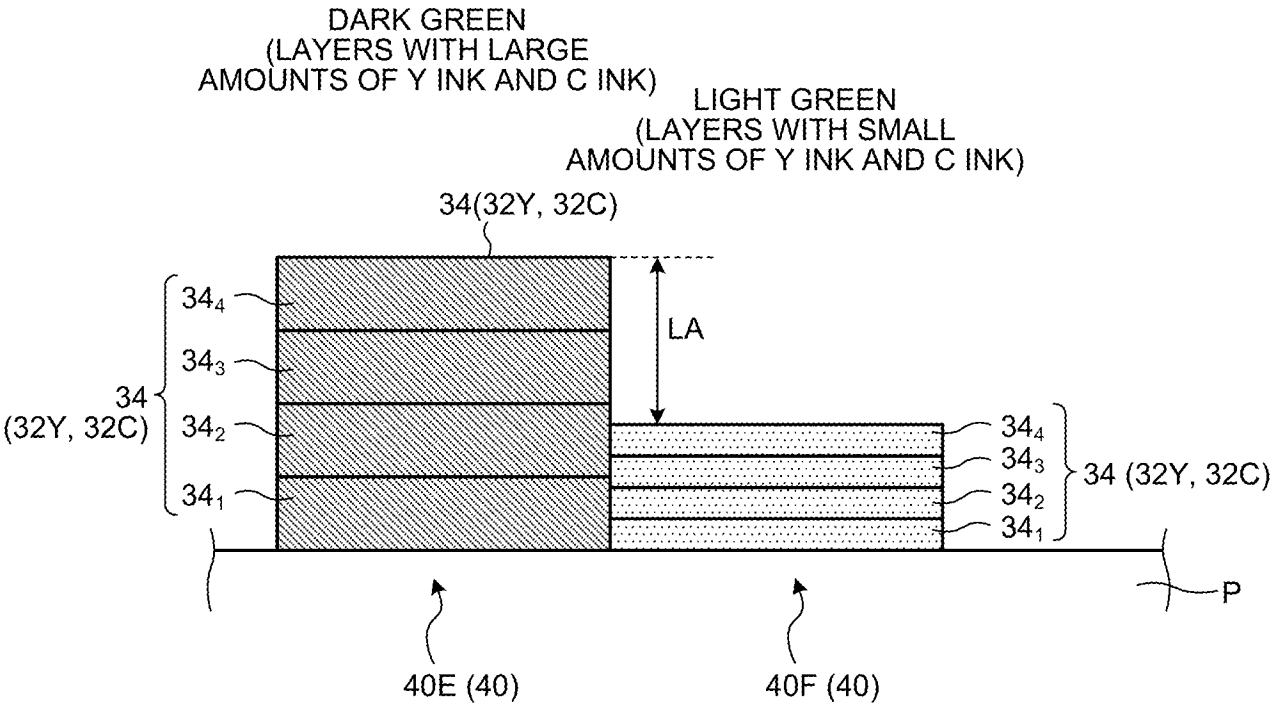
FIG. 6 is a diagram illustrating an example of a cross section of an image formed by the conventional system.

FIG. 6 is a diagram illustrating an example of a cross section of an image formed with the dots 34 (dots $\mathbf{34}_1$ to $\mathbf{34}_4$) of four layers by the conventional system. Similarly to FIG. 4, it is assumed that the color of a certain pixel of image data of an image to be formed is deep green. It is assumed that the deep green dot 34 is formed in a pixel area 40E corresponding to the certain pixel on the support P. It is assumed that the color of a pixel adjacent to the certain pixel is light green. It is assumed that the light green dot 34 is formed in a pixel area 40F corresponding to the adjacent pixel on the support P.

In this case, to realize the deep green dot 34 in the pixel area 40E on the support P, greater amounts of the yellow ink droplet 32Y and the cyan ink droplet 32C than the amount of ink of a color with a lower density are ejected and thereafter cured by the irradiation units 20 to form the dot 34 of one layer. Then, four layers of the dots 34 (the dots $\mathbf{34}_1$ to $\mathbf{34}_4$) are laminated, for example. To realize the light green dot 34 in the pixel area 40F, less than the predetermined amounts (small amounts) of the yellow ink droplet 32Y and the cyan ink droplet 32C are ejected and thereafter cured by the irradiation units 20 to form the dot 34 of one layer. Then, four layers of the dots 34 (the dots $\mathbf{34}_1$ to $\mathbf{34}_4$) are laminated, for example.

However, as described above, there is a difference in the thickness of ejected ink in each of the layers, so that an unintended thickness difference on an image increases with an increase in the number of the layers (see LA in FIG. 6). The same occurs when the support P is three-dimensional.

Figure 7:
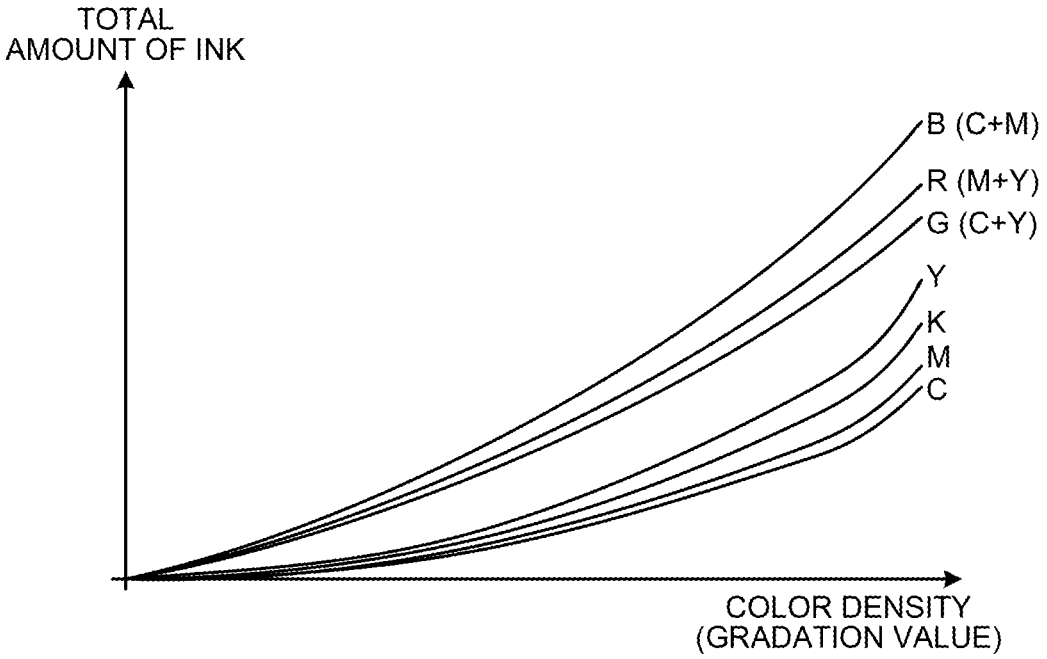
FIG. 7 is a diagram illustrating an example of a relationship between a color density and a total amount of ink.

FIG. 7 is a diagram illustrating an example of a relationship between a color density of image data and a total amount of ink ejected to the pixel area 40 to realize the color density.

In FIG. 7, it is assumed that the recording unit 14 can eject the ink droplet 32A of four colors of cyan, magenta, yellow, and black. The color density of each pixel of the image data is indicated by a gradation value (pixel value) of each pixel. A greater gradation value indicates a higher density, and a smaller gradation value indicates a lower density. Therefore, as illustrated in FIG. 7, the total amount of ink ejected according to each pixel of the image data increases as the color density of each pixel increases. The total amount of ink indicates a total amount of ink ejected to the pixel area 40 corresponding to each pixel to realize a color corresponding to each pixel.

Further, the ejection amount of the ink droplet 32A needed to realize a color with a certain density varies depending on ink components of the ink droplet 32A. Therefore, as illustrated in FIG. 7, the total amount of ink needed to realize the same density varies depending on the color of the ink droplet 32A.

The relationship between the total amount of ink and the color density illustrated in FIG. 7 is one example, and is not limited to that illustrated in FIG. 7.

Referring back to FIG. 3, in view of the above, in the embodiment, the main control unit 13 includes the first calculating unit 12B, the setting unit 12C, the second calculating unit 12D, the first generating unit 12E, the second generating unit 12F, the output unit 12G, and the storage unit 12H.

The first calculating unit 12B calculates a thickness of ejected ink for each pixel on the basis of image data acquired by the acquiring unit 12A. The thickness of ejected ink indicates a thickness of ink of an image formed in accordance with the image data. Specifically, the thickness of ejected ink indicates a thickness of ink that is ejected and cured. The thickness of ink for each pixel indicates a thickness of ink in each of the pixel areas 40 corresponding to the respective pixels in an image formed on the support P.

In the embodiment, the first calculating unit 12B reads color information and a gradation value of each pixel indicated in the image data. As described above, the ejection amount of ink ejected from each of the nozzles 18 is determined by the color of each pixel (specifically, the color information and the gradation value). Further, the thickness of ejected ink corresponding to the ejection amount varies depending on the ejection amount of ink and the property of ink.

Therefore, in the embodiment, a case will be described in which the first calculating unit 12B calculates, from the image data, a total amount of ink to be ejected for each pixel. That is, the first calculating unit 12B calculates the total amount of ink for each pixel as the thickness of ink for each pixel.

Specifically, the first calculating unit 12B stores a look-up table (LUT), which indicates a relationship of the color information and the gradation value of each pixel and the amount of ink to be ejected, in the storage unit 12H in advance. Then, the first calculating unit 12B reads the color information and the gradation value of each pixel from the image data. The first calculating unit 12B calculates, for each pixel, a total amount of ink to be ejected according to the color information and the gradation value by using the LUT.

The storage unit 12H may store, in advance, an LUT indicating a relationship of the color information and the gradation value of each pixel and the amount of ejected ink. In this case, the first calculating unit 12B reads the color information and the gradation value of each pixel from the image data. Then, the first calculating unit 12B may calculate, for each pixel, a thickness of ink corresponding to the read color information and the read gradation value of each pixel by using the LUT.

When the image data indicates that a plurality of layers of the dots 34 are to be laminated on the support P, the first calculating unit 12B calculates the thickness of ejected ink for each pixel in each of the layers of the dots 34 to be laminated. Similarly to the above, in the embodiment, the first calculating unit 12B calculates a total amount of ink to be ejected, as the thickness of ejected ink, for each pixel in each of the layers of the dots 34 to be formed.

The setting unit 12C sets a target thickness of the image to be formed on the support P. The setting unit 12C sets, as the target thickness, a value equal to or greater than the maximum value of the thickness of ink calculated for each pixel of the image data. It is sufficient that the target thickness is a value equal to or greater than the maximum value of the thickness of ink calculated for each pixel; however, it is preferable that the target thickness is the maximum value of the thickness of ink calculated for each pixel.

Figure 8A:
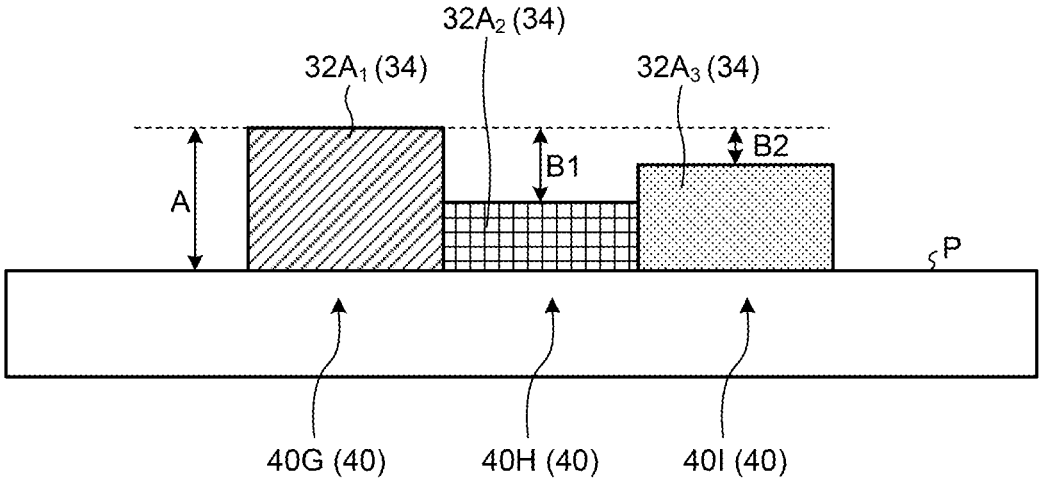
FIGS. 8A to 8C are diagrams for explaining an image formed on a support.
Figure 8B:
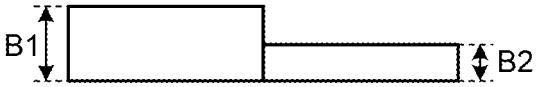
Figure 8C:
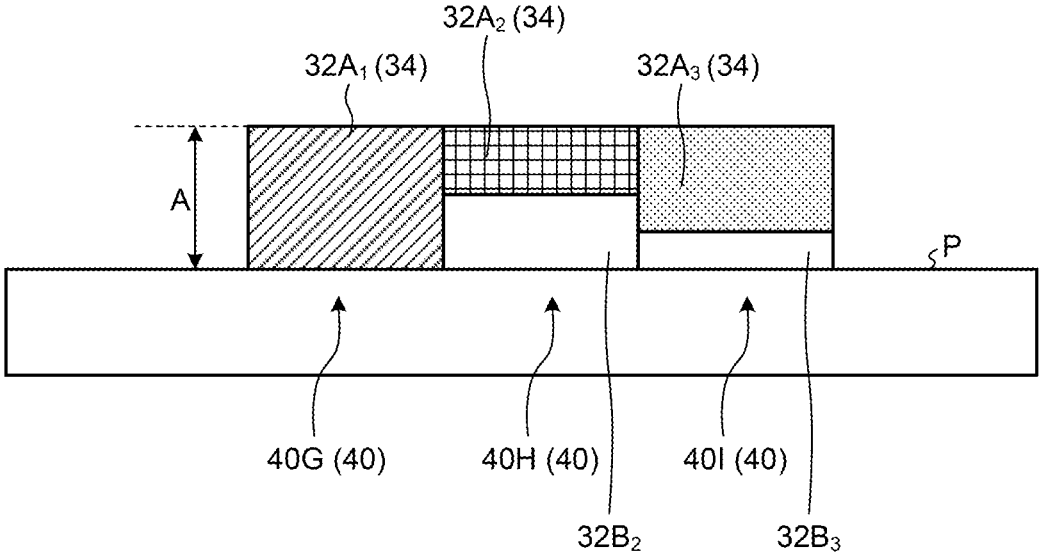

FIGS. 8A to 8C are diagrams for explaining an image formed on the support P. FIG. 8A is a schematic diagram illustrating a case in which the dots 34 with ink droplets 32$A_1$ to 32$A_3$ are respectively formed in a pixel area 40G, a pixel area 40H, and a pixel area 40I on the support P on the basis of the image data. It is assumed that the total amount of ink indicated by the image data increases in the order of the pixel area 40H, the pixel area 40I, and the pixel area 40G. In this case, the thickness of ejected ink increases in the order of the pixel area 40H, the pixel area 40I, and the pixel area 40G.

In this case, the setting unit 12C sets, as the target thickness (see A in FIGS. 8A to 8C), only the thickness of the dot 34 in the pixel area 40G, which is the greatest thickness among the dots 34 of the ink droplets 32$A_1$ to 32$A_3$.

Referring back to FIG. 3, as described above, in the embodiment, the first calculating unit 12B reads the color information and the gradation value of each pixel from the image data and calculates the total amount of ink to be ejected for each pixel. Therefore, the setting unit 12C sets the maximum value of the total amount of ink calculated for each pixel as a target amount of ink to realize the target thickness.

When the image data indicates that a plurality of layers of the dots 34 are to be laminated on the support P, the setting unit 12C may set a target thickness for each layer. Specifically, the setting unit 12C may set a thickness of ink of a pixel that has the greatest thickness of ink among all of the pixels in the same layer, as a target thickness of this layer. Even in this case, the setting unit 12C sets a total amount of ink of a pixel that has the greatest total amount of ink among all of the pixels in the same layer as the target amount of ink to realize the target thickness of this layer.

Further, the setting unit 12C may set a target thickness common to a plurality of layers. In this case, the setting unit 12C sets the maximum value of a total amount of ink calculated for all of the pixels of each of the layers as the target amount of ink to realize the target thickness of each of the layers.

The second calculating unit 12D calculates a difference between the target thickness set by the setting unit 12C and the thickness of ink for each pixel.

The second calculating unit 12D calculates the difference for each pixel by subtracting the thickness of ink calculated for each pixel from the target thickness set by the setting unit 12C.

In the example illustrated in FIG. 8A, the thickness of the dot 34 in the pixel area 40G (see A in FIGS. 8A to 8C), which is the greatest thickness of ink, is set as the target thickness.

Therefore, the second calculating unit 12D calculates a difference B1 and a difference B2 from the target thickness A for respective pixels corresponding to the pixel area 40H and the pixel area 40I.

Referring back to FIG. 3, in the embodiment, the setting unit 12C sets the target thickness and calculates the target amount of ink to realize the target thickness. Therefore, the second calculating unit 12D calculates a difference for each pixel by subtracting the total amount of ink calculated for each pixel from the target amount of ink.

The first generating unit 12E generates complementary data, in which an ejection amount of the additional droplet 32B to realize a thickness corresponding to the difference calculated by the second calculating unit 12D is defined for each pixel.

FIG. 8B is a diagram for explaining the complementary data. As illustrated in FIG. 8A, a difference between the target thickness A and the pixel area 40H is the difference B1, and a difference between the target thickness A and the pixel area 40I is the difference B2. In this case, the first generating unit 12E generates complementary data, in which ejection amounts of the additional droplets 32B (an additional droplet $32B_1$ and an additional droplet $32B_2$) to realize the thicknesses corresponding to the difference B1 and the difference B2 are defined for the respective pixels.

Referring back to FIG. 3, specifically, the first generating unit 12E stores an LUT, which indicates a correspondence between the ejection amount of the additional droplet 32B and a thickness of the dot 34 with the ejected additional droplet 32B, in the storage unit 12H in advance.

Then, the first generating unit 12E reads, from the LUT, the ejection amount of the additional droplet 32B corresponding to the thickness of the dot 34 that matches the difference that the second calculating unit 12D has calculated for each pixel. Accordingly, the first generating unit 12E generates the complementary data.

The second generating unit 12F outputs print data containing the image data and the complementary data generated by the first generating unit 12E to the recording apparatus 30.

FIG. 8C is a diagram for explaining the print data. The print data contains the image data and the complementary data. Therefore, when the recording apparatus 30 ejects the droplet 32, to which the additional droplet 32B is added based on the above described difference, onto the pixel area 40 of each pixel in accordance with the print data, the thickness of each of the pixel areas 40 coincides with the target thickness A.

Specifically, as illustrated in FIG. 8C, a certain ejection amount of the ink droplet $32A_2$ corresponding to the image data and a certain ejection amount of the additional droplet $32B_2$ corresponding to the difference B1 are ejected in the pixel area 40H. Similarly, a certain ejection amount of the ink droplet $32A_3$ corresponding to the image data and a certain ejection amount of an additional droplet $32B_3$ corresponding to the difference B1 are ejected in the pixel area 40I. Thereafter, the droplets 32 are cured by the irradiation units 20. Therefore, the thickness of the image in each of the pixel areas 40 coincides with the target thickness A.

That is, when the first calculating unit 12B, the setting unit 12C, the second calculating unit 12D, the first generating unit 12E, and the second generating unit 12F perform the above described processes, the thickness of a formed image coincides with a target thickness regardless of the colors of pixels indicated by the image data.

Figure 9:
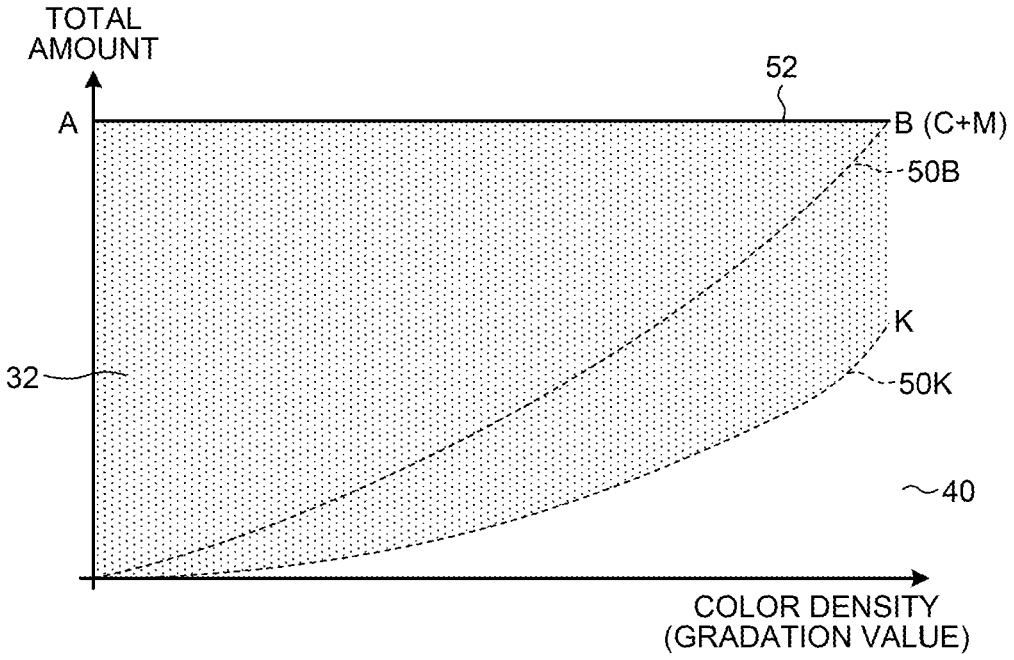
FIG. 9 is a diagram illustrating a relationship between a color density and a total amount of droplets.

FIG. 9 is a diagram illustrating a relationship between the color density (gradation value) indicated by the image data and a total amount of droplets to which the additional droplets are added in the print data generated by the second generating unit 12F.

As represented by lines 50K and 50B in FIG. 9, the total amount of ink corresponding to the color density (gradation value) indicated in the image data increases with an increase in the color density (with an increase in the gradation value). However, the ejection amount of the additional droplet 32B is determined by the complementary data for each pixel so that the target amount of ink to realize the target thickness A can be obtained. Therefore, the total amount of the droplet 32 (the ink droplet 32A and the additional droplet 32B) corresponding to the color density (gradation value) indicated in the image data becomes constant regardless of the gradation value (see a line 52).

The first generating unit 12E may generate the complementary data containing at least one of ejection information and a type of the additional droplet used as the additional droplet 32B (in the embodiment, the white additional droplet 32W or the transparent additional droplet 32T).

In the embodiment, the first generating unit 12E generates the complementary data containing, as the ejection information, any of four types of ejection information.

Specifically, the first generating unit 12E may generate the complementary data containing ejection information indicating ejection of the additional droplet 32B to an upper layer side of the ink droplet 32A that is ejected according to the image data.

The first generating unit 12E may generate the complementary data containing ejection information indicating ejection of the additional droplet 32B to a lower layer side of the ink droplet 32A that is ejected according to the image data.

The first generating unit 12E may generate the complementary data containing ejection information indicating ejection to both of the lower layer side and the upper layer side of the ink droplet 32A that is ejected according to the image data.

The first generating unit 12E may generate the complementary data containing ejection information indicating ejection of a mixture, in which the additional droplet 32B is distributed in the ink droplet 32A that is ejected according to the image data.

Figure 10:
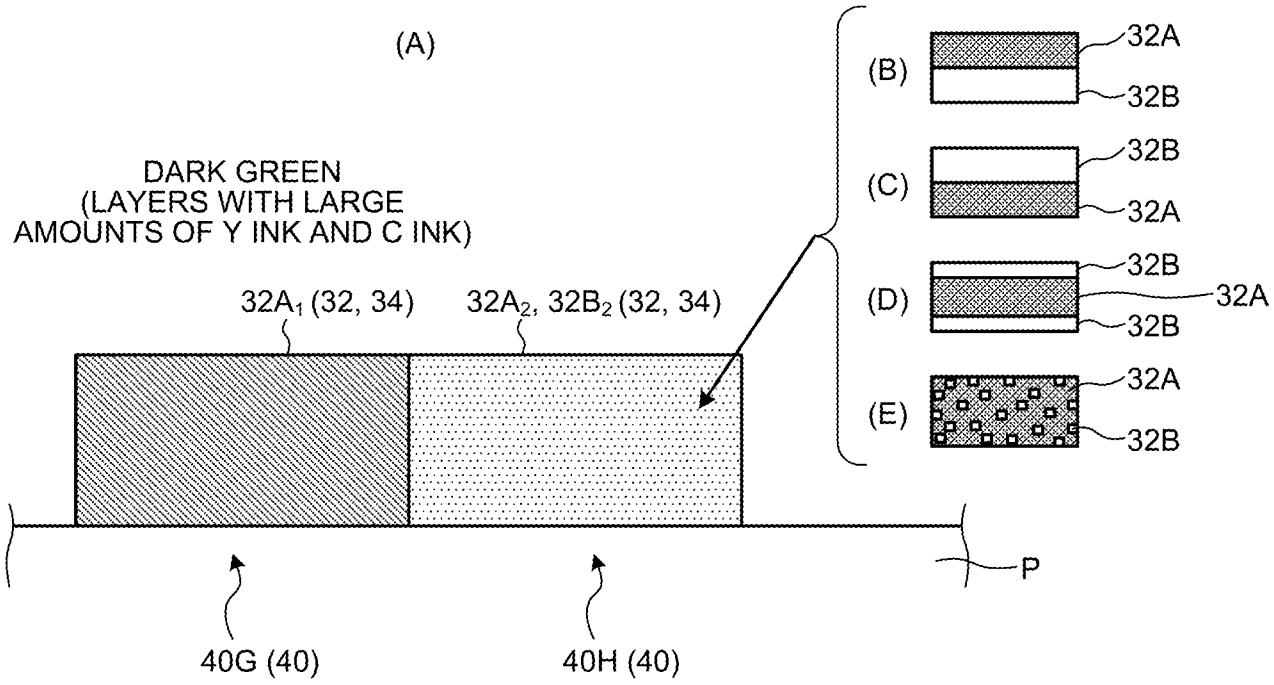
FIG. 10 is a schematic diagram illustrating a state in which droplets are ejected.

FIG. 10 is a schematic diagram illustrating a state in which the droplets 32 are ejected according to the print data.

A part (A) in FIG. 10 illustrates an example of a cross section of an image with the dots 34 of one layer. It is assumed that the color of a certain pixel of image data of an image to be formed is deep green. It is assumed that a deep green dot 34 is formed in the pixel area 40G corresponding to the certain pixel on the support P. It is assumed that the color of a pixel adjacent to the certain pixel is light green. Therefore, it is assumed that the ink droplet 32A and the additional droplet 32B are ejected to the pixel area 40H so as to coincide with the target thickness.

In the pixel area 40H to which the ink droplet 32A and the additional droplet 32B are ejected, the ink droplet 32A and the additional droplet 32B are ejected in a layered or mixed manner in accordance with the ejection information contained in the complementary data.

A part (B) in FIG. 10 is a diagram for explaining a case in which the complementary data contains the ejection information indicating ejection of the additional droplet 32B to the lower layer side of the ink droplet 32A. As illustrated in the part (B) in FIG. 10, when the ink droplet 32A and the additional droplet 32B are ejected to the pixel area 40 in accordance with the print data containing the complementary data, the recording apparatus 30 controls the recording unit 14 so as to eject the ink droplet 32A after the additional droplet 32B is ejected. Therefore, the ink droplet 32A is ejected on the additional droplet 32B in a layered manner on the support P.

A part (C) in FIG. 10 is a diagram for explaining a case in which the complementary data contains the ejection information indicating ejection of the additional droplet 32B to the upper layer side of the ink droplet 32A. As illustrated in the part (C) in FIG. 10, when the ink droplet 32A and the additional droplet 32B are ejected to the pixel area 40 in accordance with the print data containing the complementary data, the recording apparatus 30 controls the recording unit 14 so as to eject the additional droplet 32B after the ink droplet 32A is ejected. Therefore, the additional droplet 32B is ejected on the ink droplet 32A in a layered manner on the support P.

A part (D) in FIG. 10 is a diagram for explaining a case in which the complementary data contains the ejection information indicating ejection of the additional droplet 32B to both of the upper layer side and the lower layer side of the ink droplet 32A. As illustrated in the part (D) in FIG. 10, when the ink droplet 32A and the additional droplet 32B are ejected to the pixel area 40 in accordance with the print data containing the complementary data, the recording apparatus 30 controls the recording unit 14 so as to eject the droplet 32 in order of the additional droplet 32B, the ink droplet 32A, and the additional droplet 32B. Therefore, the additional droplet 32B, the ink droplet 32A, and the additional droplet 32B are ejected in this order in a layered manner on the support P.

A part (E) in FIG. 10 is a diagram for explaining a case in which the complementary data contains the ejection information indicating ejection of a mixture, in which the additional droplet 32B is distributed in the ink droplet 32A. As illustrated in the part (E) in FIG. 10, when the ink droplet 32A and the additional droplet 32B are ejected to the pixel area 40 in accordance with the print data containing the complementary data, the recording apparatus 30 controls the recording unit 14 so as to eject the mixture, in which the additional droplet 32B is distributed in the ink droplet 32A. Therefore, the mixture, in which the additional droplet 32B is distributed in the ink droplet 32A, is ejected on the support P.

When the complementary data contains the ejection information indicating ejection of the mixture in which the additional droplet 32B is distributed in the ink droplet 32A, it is preferable that the first generating unit 12E corrects the image data so as to increase the amount of the ink droplet 32A in the mixture by a predetermined rate.

It is preferable that the first generating unit 12E specifies what ejection information is to be contained in the complementary data to be generated in accordance with a print condition. Further, it is preferable that the first generating unit 12E specifies a type of the additional droplet (in the embodiment, the white additional droplet 32W or the transparent additional droplet 32T) to be used as the additional droplet 32B in accordance with the print condition.

The print condition indicates, for example, the degree of influence of the color of the support P on an image, the way an image is viewed on a surface, or the like. The first generating unit 12E may acquire the print condition from an input unit (not illustrated), or from the recording apparatus 30 or an external apparatus via a network or the like. The input unit is a keyboard or a touch panel that receives an operation instruction from a user.

For example, it is assumed that the print condition includes priority information indicating that priority is given to the way an image is viewed on the surface. In this case, the first generating unit 12E specifies the ejection information indicating ejection of the additional droplet 32B to the lower layer side of the ink droplet 32A. Further, the first generating unit 12E specifies the white additional droplet 32W as the type of the additional droplet 32B. Then, the first generating unit 12E generates the complementary data containing the ejection information and the type of the additional droplet 32B specified as above.

This is because, when the ink droplet 32A is placed on the white additional droplet 32W in a layered manner, it is possible to reproduce the same color as obtained by ejecting the ink droplet 32A directly to the support P.

The first generating unit 12E may specify, as the additional droplet 32B, the droplet 32 of the same type of color as the support P.

When the print condition indicates that a plurality of the dots 34 are formed in a layered manner, it is preferable that the first generating unit 12E specifies the transparent additional droplet 32T as the additional droplet 32B. This is to prevent the boundaries of the layers from being viewed as a line or the like due to formation of the layers of the white additional droplets 32W, thereby preventing degradation of image quality.

When the print condition indicates that a plurality of the dots 34 are formed in a layered manner, it is preferable that the first generating unit 12E specifies the ejection information indicating ejection of the mixture, in which the additional droplet 32B is distributed in the ink droplet 32A. This is to prevent the boundaries of the layers from being viewed as a line or the like, thereby preventing degradation of image quality. Further, in this case, it is preferable that the first generating unit 12E corrects image data so as to increase the amount of the ink droplet 32A in the mixture by a predetermined rate as described above. This is to prevent the color from becoming lighter due to distribution of the additional droplet 32B in the ink droplet 32A and prevent formation of an image of a color different from the color corresponding to the image data.

In the above description, a case has been explained in which the ink droplet 32A and the additional droplet 32B are ejected on the support P. However, at least a part of the support P may be formed by the recording unit 14. In this case, it is possible to flexibly adjust the shape of the support P.

In this case, it is preferable to use, as the additional droplet 32B, the same droplet as the droplet used to form the support P. Further, in this case, it is preferable that the first generating unit 12E generates the complementary data containing the ejection information indicating ejection of the additional droplet 32B to the lower layer side of the ink droplet 32A.

Figure 11:
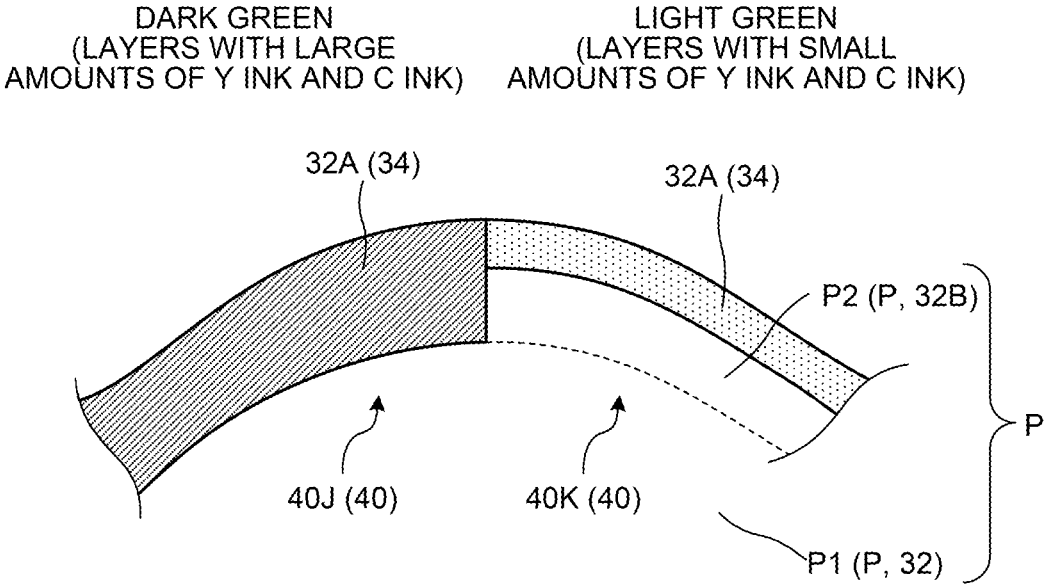
FIG. 11 is a schematic diagram illustrating a state in which droplets are ejected.

FIG. 11 is a schematic diagram illustrating a state in which the droplets 32 are ejected according to print data containing the complementary data. A support P1 is formed by ejecting the droplet 32 used to form the support P1. Then, the deep green dot 34 is formed by ejecting the ink droplet 32A to a pixel area 40J on the support P1, for example. Furthermore, in a pixel area 40K in which the light green dot 34 is to be formed, the same droplet as the droplet used to form the support P1 is ejected as the additional droplet 32B (see a support P2), and then the ink droplet 32A is ejected on the additional droplet 32B.

Therefore, the support P has a shape in which the support P2 formed with the additional droplet 32B corresponding to the above described difference is laminated on at least a part of the pixel area 40 on the support P1. Therefore, by forming an image with the ink droplet 32A on the support P, it is possible to form the surface shape of an image as intended.

Next, the flow of image processing performed by the main control unit 13 of the image processing apparatus 12 will be described.

Figure 12:
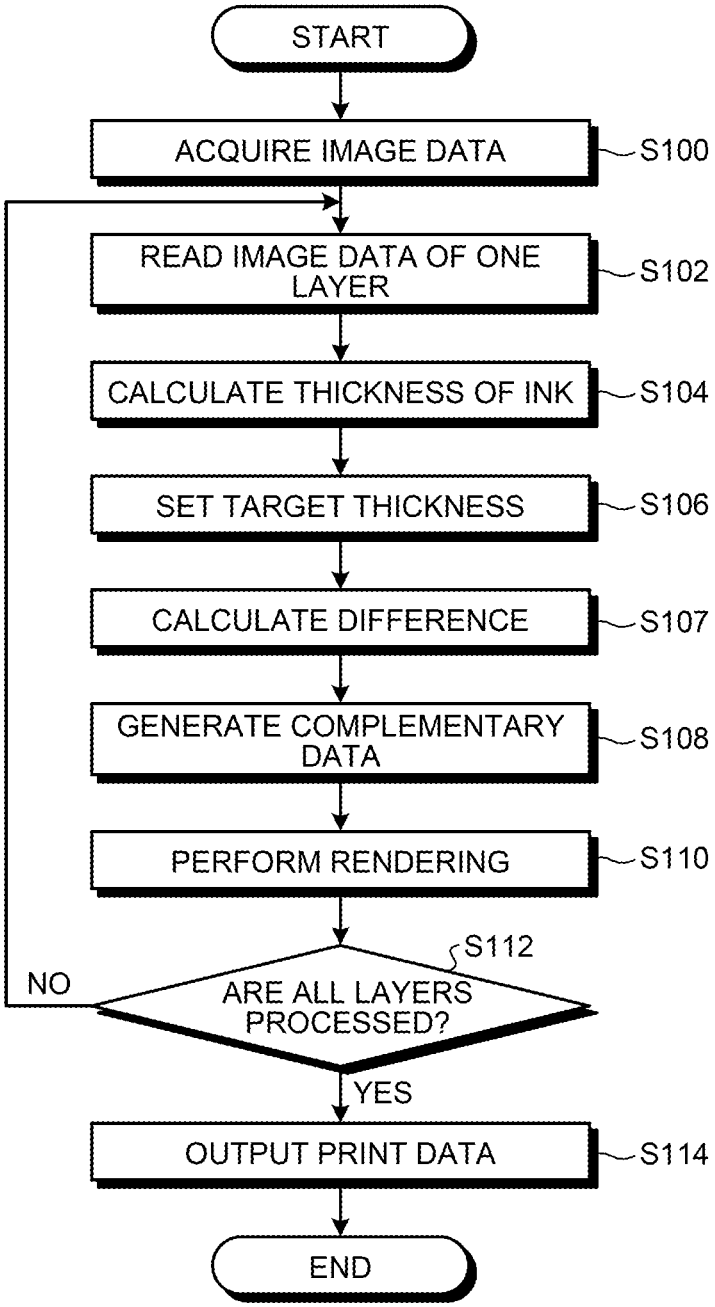
FIG. 12 is a flowchart illustrating an example of the flow of image processing.

FIG. 12 is a flowchart illustrating an example of the flow of image processing performed by the main control unit 13.

First, the acquiring unit 12A acquires image data from an external apparatus or the like (not illustrated) (Step S100). The first calculating unit 12B reads image data of one layer, on which processes from Step S104 to Step S112 (to be described later) are not performed, in the image data acquired at Step S100 (Step S102).

The first calculating unit 12B calculates a thickness of ejected ink for each pixel on the basis of the image data read at Step S102 (Step S104).

The setting unit 12C sets, as a target thickness, a value equal to or greater than the maximum value of the thickness of ink that is calculated for each pixel at Step S104 (Step S106).

The second calculating unit 12D calculates a difference between the target thickness set at Step S106 and the thickness of ink calculated at Step S104 for each pixel (Step S107).

The first generating unit 12E generates complementary data (Step S108).

The second generating unit 12F performs rendering of the image data acquired by the acquiring unit 12A and the complementary data generated at Step S108 (Step S110).

The main control unit 13 determines whether or not the processes from Step S104 to Step S110 are completed on image data of all of layers contained in the image data acquired at Step S100 (Step S112).

If a determination result is negative at Step S112 (NO at Step S112), the process returns to Step S102. If a determination result is positive at Step S112 (YES at Step S112), the process proceeds to Step S114.

At Step S114, the output unit 12G outputs the print data generated through the processes from Step S100 to Step S112 as described above to the recording apparatus 30 (Step S114). Then, the routine is finished.

As described above, in the image processing apparatus 12 according to the embodiment, the acquiring unit 12A acquires image data of an image formed by the recording unit 14 using an inkjet system. The first calculating unit 12B calculates a thickness of ejected ink for each pixel on the basis of the image data. The setting unit 12C sets a target thickness of the image. The second calculating unit 12D calculates a difference between the target thickness and the thickness of ink. The first generating unit 12E generates complementary data, in which an ejection amount of the additional droplet 32B to realize a thickness corresponding to the difference is defined for each pixel. The second generating unit 12F generates print data containing the image data and the complementary data.

In this manner, in the embodiment, the complementary data is generated, in which the ejection amount of the additional droplet 32B to realize a thickness corresponding to a difference between the target thickness and the thickness of ink is defined for each pixel. Then, the print data containing the image data and the complementary data is generated.

In the recording apparatus 30, certain ejection amounts of the ink droplet 32A and the additional droplet 32B corresponding to each pixel are ejected based on the print data. Therefore, in the embodiment, it is possible to prevent occurrence of an unintended thickness difference in a formed image.

Consequently, in the image processing apparatus 12 according to the embodiment, it is possible to prevent occurrence of an unintended thickness difference in a formed image due to the color of a pixel indicated by the image data.

Next, a hardware configuration of the main control unit 13 according to the embodiment will be described.

The main control unit 13 includes a CPU, a read only memory (ROM), a random access memory (RAM), a hard disk drive (HDD), a hard disk (HD), a network interface (I/F), and an operation panel. The CPU, the ROM, the RAM, the HDD, the HD, the network I/F, and the operation panel are connected to one another via a bus, and implement a hardware configuration using a normal computer.

A computer program for executing various processes performed by the main control unit 13 according to the embodiment is provided by being incorporated in a ROM or the like.

The computer program for executing various processes performed by the main control unit 13 according to the embodiment may be provided by being recorded in a computer-readable recording medium, such as a compact disc (CD)-ROM, a flexible disk (FD), compact-disk recordable (CD-R), or a digital versatile disk (DVD), in a computer-installable or computer-executable file format or the like.

The computer program for executing various processes performed by the main control unit 13 according to the embodiment may be stored in a computer connected to a network, such as the Internet, and provided by being downloaded via the network. The computer program for executing various processes performed by the main control unit 13 according to the embodiment may be provided or distributed via a network, such as the Internet.

The computer program for executing various processes performed by the main control unit 13 according to the embodiment has a module structure including the above described units (the acquiring unit 12A, the first calculating unit 12B, the setting unit 12C, the second calculating unit 12D, the first generating unit 12E, the second generating unit 12F, the output unit 12G, and the storage unit 12H). As actual hardware, the CPU reads each of computer programs from a storage medium, such as a ROM, and executes the computer programs, so that the above described units are loaded on the main storage device and generated on the main storage device.

According to an embodiment of the present invention, it is possible to prevent occurrence of an unintended thickness difference in a formed image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image processing apparatus comprising:

an acquiring unit that acquires image data of an image to be formed by a recording unit using an inkjet system;

a first calculating unit that calculates a thickness of ejected ink for each pixel based on the image data;

a setting unit that sets a target thickness of the image;

a second calculating unit that calculates a difference between the target thickness and the thickness of ink for each pixel;

a first generating unit that generates complementary data, in which an ejection amount of an additional droplet to realize a thickness corresponding to the difference is defined for each pixel; and a second generating unit that generates print data containing the image data and the complementary data.

2. The image processing apparatus according to claim 1, wherein the setting unit sets, as the target thickness, a value equal to or greater than a maximum value of the thickness of ink calculated for each pixel in the image data.

3. The image processing apparatus according to claim 1, wherein the first generating unit generates the complementary data containing ejection information indicating ejection of the additional droplet to an upper layer side of an ink droplet that is ejected according to the image data.

4. The image processing apparatus according to claim 1, wherein the first generating unit generates the complementary data containing ejection information indicating ejection of the additional droplet to a lower layer side of an ink droplet that is ejected according to the image data.

5. The image processing apparatus according to claim 1, wherein the first generating unit generates the complementary data containing ejection information indicating ejection of the additional droplet to both of a lower layer side and an upper layer side of an ink droplet that is ejected according to the image data.

6. The image processing apparatus according to claim 1, wherein the first generating unit generates the complementary data containing ejection information indicating ejection of a mixture, in which the additional droplet is distributed in an ink droplet that is ejected according to the image data.

7. The image processing apparatus according to claim 6, wherein the first generating unit corrects the image data so as to increase an amount of the ink droplet in the mixture by a predetermined rate.

8. The image processing apparatus according to claim 1, wherein the first calculating unit calculates a thickness of ejected ink for each pixel in each of layers of dots to be laminated, on the basis of the image data, the setting unit sets the target thickness for each of the layers, the second calculating unit calculates a difference between the target thickness and the thickness of ink for each pixel in each of the layers, and the first generating unit generates the complementary data, in which an ejection amount of an additional droplet to realize a thickness corresponding to the difference is defined for each pixel in each of the layers.

9. The image processing apparatus according to claim 1, wherein the additional droplet is white or transparent in color.

10. The image processing apparatus according to claim 1, wherein the additional droplet has the same type of color as a support on which an image is to be formed.

11. The image processing apparatus according to claim 1, wherein the ink droplet and the additional droplet are curable with stimulus.

12. An image processing method comprising:

acquiring image data of an image to be formed by a recording unit using an inkjet system;

calculating a thickness of ejected ink for each pixel based on the image data;

setting a target thickness of the image;

calculating a difference between the target thickness and the thickness of ink for each pixel;

generating complementary data, in which an ejection amount of an additional droplet to realize a thickness corresponding to the difference is defined for each pixel; and generating print data containing the image data and the complementary data.

13. An image processing system comprising:

an image processing apparatus; and a recording apparatus, wherein the image processing apparatus includes:

an acquiring unit that acquires image data of an image to be formed by a recording unit using an inkjet system;

a first calculating unit that calculates a thickness of ejected ink for each pixel based on the image data;

a setting unit that sets a target thickness of the image;

a second calculating unit that calculates a difference between the target thickness and the thickness of ink for each pixel;

a first generating unit that generates complementary data, in which an ejection amount of an additional droplet to realize a thickness corresponding to the difference is defined for each pixel;

a second generating unit that generates print data containing the image data and the complementary data; and an output unit that outputs the print data to the recording apparatus, and the recording apparatus includes the recording unit.

* * * * *